US010648628B2

(12) United States Patent
Renders et al.

(10) Patent No.: US 10,648,628 B2
(45) Date of Patent: May 12, 2020

(54) LIGHTING ASSEMBLY, LAMP FOR USE IN THE LIGHTING ASSEMBLY, AND METHOD OF CONTROLLING THEREOF

(71) Applicant: EXPLORENTIS, Leuven (BE)

(72) Inventors: Yoeri Bertha Jozef Renders, Halen (BE); Olivier Leirs, Leuven (BE)

(73) Assignee: Explorentis, Boutersem (BE)

( * ) Notice: Subject to any disclaimer, the term of this patent is extended or adjusted under 35 U.S.C. 154(b) by 0 days.

(21) Appl. No.: 16/087,667

(22) PCT Filed: Mar. 23, 2017

(86) PCT No.: PCT/BE2017/000019
§ 371 (c)(1),
(2) Date: Sep. 24, 2018

(87) PCT Pub. No.: WO2017/161426
PCT Pub. Date: Sep. 28, 2017

(65) Prior Publication Data

US 2019/0101252 A1 Apr. 4, 2019

(30) Foreign Application Priority Data

Mar. 24, 2016 (BE) ..... 2016/5212

(51) Int. Cl.
*H05B 37/02* (2006.01)
*F21S 4/10* (2016.01)
(Continued)

(52) U.S. Cl.
CPC ..... *F21S 4/10* (2016.01); *F21V 23/001* (2013.01); *H05B 45/20* (2020.01); *H05B 45/46* (2020.01);
(Continued)

(58) Field of Classification Search
CPC ..... H05B 37/0272; H05B 33/0842; H05B 33/0845; H05B 33/0857
(Continued)

(56) References Cited

U.S. PATENT DOCUMENTS 6,211,626 B1 4/2001 Lys et al.
2005/0169643 A1* 8/2005 Franklin ..... H04B 10/1141 398/187
(Continued)

FOREIGN PATENT DOCUMENTS

EP 2466996 A2 6/2012
EP 2963997 A1 1/2016

*Primary Examiner* — Thuy V Tran
(74) *Attorney, Agent, or Firm* — N.V. Nederlandsch Octrooibureau; Catherine A. Shultz; Katelyn J. Bernier

(57) ABSTRACT

A lamp for use in a lighting assembly comprising a two-wire light string, wherein the lamp is adapted for fitting in a socket of the two-wire light string, and receiving a voltage signal and a superimposed control signal via the two-wire light string and the socket. The lamp includes control electronics provided for the purpose, when the lamp has been fitted in a socket, of receiving voltage via the voltage signal and receiving instructions via the control signal superimposed on the voltage signal; and at least one LED source, of which at least one of an intensity and a colour is adjustable on the basis of the instructions via the control electronics. The control electronics are further provided for receiving an address for the lamp via the control signal superimposed on the voltage signal and for subsequently confirming receipt of the address.

19 Claims, 4 Drawing Sheets

(51) Int. Cl.

| | |
|---|---|
| ***H05B 45/20*** | (2020.01) |
| ***H05B 45/46*** | (2020.01) |
| ***H05B 47/155*** | (2020.01) |
| ***H05B 47/185*** | (2020.01) |
| ***F21V 23/00*** | (2015.01) |

(52) U.S. Cl.
CPC ..... *H05B 47/155* (2020.01); *H05B 47/185* (2020.01)

(58) Field of Classification Search
USPC ..... 315/185 R, 291
See application file for complete search history.

(56) References Cited

U.S. PATENT DOCUMENTS

| | | | | |
|---|---|---|---|---|
| 2012/0262080 | A1* | 10/2012 | Watanabe ..... | H05B 33/0818 315/210 |
| 2014/0021879 | A1* | 1/2014 | Yu ..... | H05B 33/0815 315/206 |
| 2014/0265880 | A1 | 9/2014 | Taipale et al. | |
| 2014/0265897 | A1 | 9/2014 | Taipale et al. | |
| 2015/0102739 | A1 | 4/2015 | Millar et al. | |

* cited by examiner

LIGHTING ASSEMBLY, LAMP FOR USE IN THE LIGHTING ASSEMBLY, AND METHOD OF CONTROLLING THEREOF

The invention relates to a lighting assembly comprising a light string, wherein sockets are placed in parallel at different positions of the light string and wherein each of the sockets is provided so as to connect a lamp to at least two of the multiple wires. The invention further relates to a method for controlling such a lighting assembly.

BACKGROUND

Lighting assemblies with a light string are known and are used mainly as festive lighting, for instance Christmas lighting, and as decorative lighting. Such a light string is therefore also referred to as a party light string. Typically provided in party light strings are lamps of different colours, and/or the lamps are switched on and off in predetermined patterns in order to create a festive atmosphere. Different techniques are known for realizing this.

According to a first technique, multi-wire light strings are provided wherein different sockets are connected between different pairs of the multi-wire light string and wherein a different voltage pattern is applied over the different pairs of the multi-wire light string for the purpose of controlling the lamps. Lamps which are attached between a first pair of wires of the multi-wire light string will as a result be switched on and off according to a first pattern and those attached between a second pair of wires of the multi-wire light string can be switched on and off according to a pattern differing therefrom.

Provided according to another system is a multi-wire light string wherein a first pair of wires is provided in order to supply a voltage to substantially all lamps, while another pair of wires is provided to supply control signals to each of the lamps. Each lamp must then be provided with a control unit for interpreting the control signal and controlling the lamp accordingly, wherein the lamp and the control unit are provided with voltage by the power wires.

SUMMARY

It is an object of the invention to provide a lighting assembly wherein a simple two-wire light string acquires an enhanced functionality.

The invention provides for this purpose a method for controlling a lighting assembly comprising a two-wire light string, wherein sockets are placed in parallel at different positions of the light string, wherein each of the sockets is provided so as to connect a lamp to the two wires and wherein a controller is provided at one end of the light string, wherein the method comprises of:

- providing a voltage signal over the two wires with the controller;
- superposing a control signal on the voltage signal of the lighting assembly;
- blocking propagation of the control signal from the light string to a mains connection of the controller with a filter in the controller;

wherein the method comprises of initializing the light string by the following steps of:

- starting an initializing cycle in which the following sequence of steps is repeated of:
  - repeatedly transmitting an address for a lamp as control signal with the controller;

- fitting a lamp in one of the sockets, which lamp comprises at least one LED source, of which at least one of an intensity and a colour is adjustable on the basis of instructions via control electronics in the lamp, and wherein the control electronics are provided for the purpose, when the lamp has been fitted in a socket, of receiving voltage via the voltage signal and receiving the instructions via the control signal;
  - the lamp receiving the address;
  - generating an intensity peak of the at least one LED source with the control electronics following receipt of the address;
  - detecting with the controller a current peak resulting from the generated intensity peak for the purpose of confirming receipt of the address by the lamp;
- stopping the initializing cycle;
- starting a working cycle wherein the control signal comprises instructions for each initialized lamp.

The method according to the invention allows phased conversion of a conventional two-wire light string to an intelligent light string, wherein in a first phase a controller and at least one lamp is provided which is controlled intelligently, wherein other lamps can be conventional lamps, and wherein the intelligent lamp can be set by means of superimposing the control signal. The initializing cycle allows initializing of the light string in a dynamic manner in an extremely simple and user-friendly way, wherein it is irrelevant how many intelligent lamps are placed in the light string. The controller transmits an address for a lamp and continues to transmit it until a confirmation is detected that a lamp has received the address. When the lamp is fitted, the lamp receives the address and, in response to receipt of the address, the lamp will generate an intensity peak. This intensity peak results in a current peak which is detected by the controller and interpreted as confirmation that the address has been received by the lamp. The controller can then transmit a subsequent address and wait until a further lamp confirms this subsequent address in a similar manner. By repeating this sequence of steps, wherein a different address is transmitted at a time by the controller, a plurality of lamps can be provided in simple manner with an address. The lamps do not have to send an active confirmation signal here, and this considerably simplifies the electronics in the lamps. This is because a one-way communication will as a result be sufficient to configure and bring about operation of the system. An inexpensive lighting assembly can hereby be created which is nevertheless dynamic and flexible and easily adjustable.

The method preferably further comprises that in the working cycle the controller transmits successive instructions as control signal for each address, and each lamp is provided so as to filter the instructions related to its received address out of the control signal. In the working cycle each lamp can hereby be provided with different instructions, so that each lamp is controllable in unique manner. Successively transmitting the instructions for each lamp enables each lamp to be provided with a simple counter in order to count when its instructions are transmitted. The number of bits per instruction can hereby be reduced considerably.

The method preferably further comprises of forming the voltage signal with a periodic progression, wherein the control signal is transmitted during at least one time segment within the periodic progression. The LEDs are more preferably provided so as to switch on and off within another time segment which has no overlap with the one time segment and thus draw power from the voltage signal.

Switching LEDs on and off, particularly when this takes place via a PWM in order to dim the LED, could cause interference in the control signal. It is therefore advantageous to transmit the control signal during a first time segment differing from the time segment in which the LED is provided with power.

The method preferably further comprises of setting the controller via a communication device. The communication device is preferably an end-user device such as a computer, laptop, tablet, smart phone, smart watch or other fixed or portable end-user electronic communication device. This method step allows a user to select different ambiences or settings.

Each lamp preferably has a memory for storing the address, and wherein each lamp is configured to be available to receive the address for a first predetermined period after receiving the voltage signal. When each lamp is configured to be available for a predetermined period to receive an address, lamps can be set in simple manner. A predetermined period in this context is a predetermined period of time and the lamp is only available to receive the address during this predetermined period of time. This predetermined period of time begins when the voltage signal is received. In other words, when a light string with a plurality of already fitted lamps is 'on', the already fitted lamps have been receiving the voltage signal since the light string has been 'on'. The predetermined period of time after receiving the voltage signal will therefore have passed for the already fitted lamps, whereby they will not respond to a new address that is transmitted. When an additional lamp is placed in a socket, this additional lamp will, as a result of being placed in the socket, receive the voltage signal. This additional lamp hereby enters the predetermined period and is thus available to receive the new address that is transmitted. Addresses can in this way be assigned in dynamic and flexible manner to lamps without complex addressing and without two-way data communication.

The availability for receiving the address preferably comprises of reading the control signal in order to detect an address therein and of storing the detected address in the memory. The control signal comprises an address which is transmitted repeatedly. This address can be detected by the lamp when the lamp is available for receiving the address. When the lamp detects the address, the lamp will store the detected address in the memory when the lamp is available for receiving the address. An address is in this way assigned to the lamp, in the memory thereof.

Following the first predetermined period the lamp preferably enters an operating mode in which the control electronics are provided so as to read the control signal in order to receive instructions related to the address stored in the memory. In the operating mode a lamp will respond only to its own address. The control electronics more specifically read the control signal in order to retrieve therefrom the address corresponding to the address stored in the memory of the lamp. When this address is detected, the lamp will read and execute the instructions related to this address. When the light string is in the initializing mode and an already placed lamp is in the operating mode, the already placed lamp will typically not respond to the control signal because the control signal comprises only of a repeated transmission of a new address. This new address does not form a trigger for the already placed lamp in the operating mode, so that the already placed lamp will not respond thereto.

The invention further relates to a lighting assembly comprising a two-wire light string, wherein sockets are placed in parallel at different positions of the light string, wherein each of the sockets is provided so as to connect a lamp to the two-wires, and wherein a controller is provided at one end of the light string, which controller is provided so as to provide a voltage signal over the two wires, and which controller is further provided so as to superimpose a control signal on the voltage signal, wherein the controller further comprises a mains connection and comprises a filter between the two-wire light string and the mains connection, which filter is provided for the purpose of blocking propagation of the control signal from the light string to the mains connection, wherein the lighting assembly further comprises at least one lamp which is adapted for fitting in the socket and which comprises at least one LED source, of which at least one of an intensity and a colour is adjustable on the basis of instructions via control electronics in the lamp, and wherein the control electronics are provided for the purpose, when the lamp has been fitted in a socket, of receiving voltage via the voltage signal and receiving the instructions via the control signal, wherein the controller is configured to repeatedly transmit an address for a lamp as control signal during an initializing cycle prior to a working cycle, wherein the lamp is provided so as to generate an intensity peak of the at least one LED source after receiving the address, and wherein the controller is configured to detect a current peak resulting from the generated intensity peak for the purpose of confirming receipt of the address by the lamp, wherein the controller is further configured to generate instructions for each initialized lamp as control signal in a working cycle.

The lighting assembly according to the invention is configured such that any two-wire light string with sockets can form a basis for the lighting assembly of the invention. Light fittings in which a light string or technically equivalent wiring is provided, such as a rail with current-carrying conductors which are made for lighting purposes and can be employed in for instance shops and offices, can also form the basis for the lighting assembly of the invention. Providing a controller is sufficient to make an intelligent two-wire light string according to the invention from a non-intelligent two-wire light string and thereby considerably enhance the functionality of a conventional two-wire light string. The controller is provided so as to apply a voltage signal over the two wires and is further provided so as to superimpose a control signal on the voltage signal. The controller further comprises a filter here so that the control signal cannot propagate to the mains connection. As a result the controller can be placed in simple manner and in different situations to control a two-wire light string without this having an adverse effect on the mains electricity. Because a voltage signal is applied over the two wires, conventional lamps can be placed in the sockets, which conventional lamps will then operate on the basis of the voltage signal.

The lighting assembly according to the invention hereby allows lamps provided with control electronics to be given instructions so that the intensity and/or colour of these lamps is adjustable via the control signal. Lamps not provided with control electronics, such as conventional lamps, will be provided with power by the voltage signal and operate on the basis thereof. The two-wire light string can hereby be thus provided with a combination of conventional lamps, which will be controlled by the voltage signal, and intelligent lamps which are provided with energy via the voltage signal but wherein the intensity and/or colour is regulated via the control signal. Hereby obtained is a lighting assembly which is dynamic in use and wherein different types of lamps can be intermixed in the light string, while each lamp is optimally operational. This allows a user of the lighting assembly to convert an existing two-wire light string in phases to an intelligent light string by providing a controller and at least one intelligent lamp, wherein the lamps in the light string can be replaced at different stages by intelligent lamps in order to ultimately replace all lamps or a predetermined number of the lamps with intelligent lamps, intensity and/or colour of which are dynamically controllable via the control signal.

The lighting assembly according to the invention further allows dynamic and simple setting of lamps in a light string. The lamps can further be manufactured inexpensively. This is important because a light string can comprise a large number of lamps, and so, because of the large number of lamps, the cost of the lamp will greatly affect the overall cost of the light string. The cost of the lamp is determined to great extent by the complexity of the control electronics. The more functionalities the control electronics have, the more components have to be incorporated in order to make these functionalities possible. The lighting assembly according to the invention is configured such that control electronics need be provided only for a one-way data communication, more specifically only for reading the control signal. The control electronics can hereby only receive data. The lighting assembly is however configured to generate a confirmation of receipt of an address through an intensity peak of the LED which causes a current peak which can be detected by the controller. The control electronics hereby do not have to be provided with transmitting functionality for transmitting data to the controller. This makes it possible to manufacture the lamp in simple and inexpensive manner.

The voltage signal preferably has a periodic progression, wherein the control signal is transmitted during at least one time segment within the periodic progression. The voltage signal, which can be wholly or partially the same as the mains voltages signal, is provided by the controller with a control signal by means of superimposition, preferably at a zero crossing of the voltage signal, so that the control signal is transmitted during at least one time segment within the periodic progression. The LEDs can receive the control signal and can then draw power from the voltage signal in another time segment within the periodic progression which has no overlap with the time segment in which the control signal is transmitted. Particularly when this power is drawn from the voltage signal via a PWM, for instance with a switching frequency of about 1000 Hz, this switching could cause interference impeding communication. LEDs can typically switch on and off at high frequency via PWM so that they are only lit for a part of the time. A LED can in this way be dimmed in technically simple manner. In order to avoid interference in the control signal by the PWM the LED will draw power in a time segment other than the time segment in which the control signal is transmitted by the controller.

The controller preferably further comprises a communication module for communication with an end-user device for configuring the controller. An end-user device can be selected from a computer, laptop, tablet, smart phone, smart watch or any other known electronic end-user device suitable for communication with other devices. Such an end-user device can then be provided for the purpose of configuring the controller, for instance by selecting one of the predetermined control patterns programmed in the controller. According to another embodiment, the controller can be freely programmed by the end-user device.

Each lamp preferably has a memory for storing the address and each lamp is configured to be available to receive the address for a first predetermined period after receiving the voltage signal. The availability for receiving the address preferably comprises of reading the control signal in order to detect an address therein and of storing the detected address in the memory. Each lamp is preferably configured for the purpose, after the first predetermined period, of entering an operating mode in which the control electronics are provided so as to read the control signal in order to receive instructions related to the address stored in the memory. For the advantages and effects of these preferred features reference is made to the corresponding explanation above relating to the method. The advantages and effects of the method similarly represent advantages and effects of the lighting assembly.

The voltage signal is preferably an alternating voltage signal in a frequency lying between 40 Hz and 70 Hz. The alternating voltage signal more preferably has the same frequency as the main voltage. This allows an alternating voltage signal to be applied over the two wires in extremely simple manner via the mains voltage.

The control signal is preferably a modulated carrier wave with a frequency lying between 0.8 MHZ and 30 MHZ. Tests and calculations have indicated that, via a modulated carrier wave with a frequency between 0.8 MHZ and 30 MHZ, a two-wire light string provided with 150 to 200 lamps is sufficient for the individual supply of instructions to each of the lamps in the light string. This frequency is further found to be optimized for processing by a microprocessor in the control electronics of the lamps.

The invention further relates to a lamp of the lighting assembly according to the invention.

BRIEF DESCRIPTION OF THE DRAWINGS

The invention will now be further described with reference to an exemplary embodiment shown in the drawing.

In the drawing.

In the drawing the same or similar elements are given the same reference numeral.

DETAILED DESCRIPTION

Figure 1:
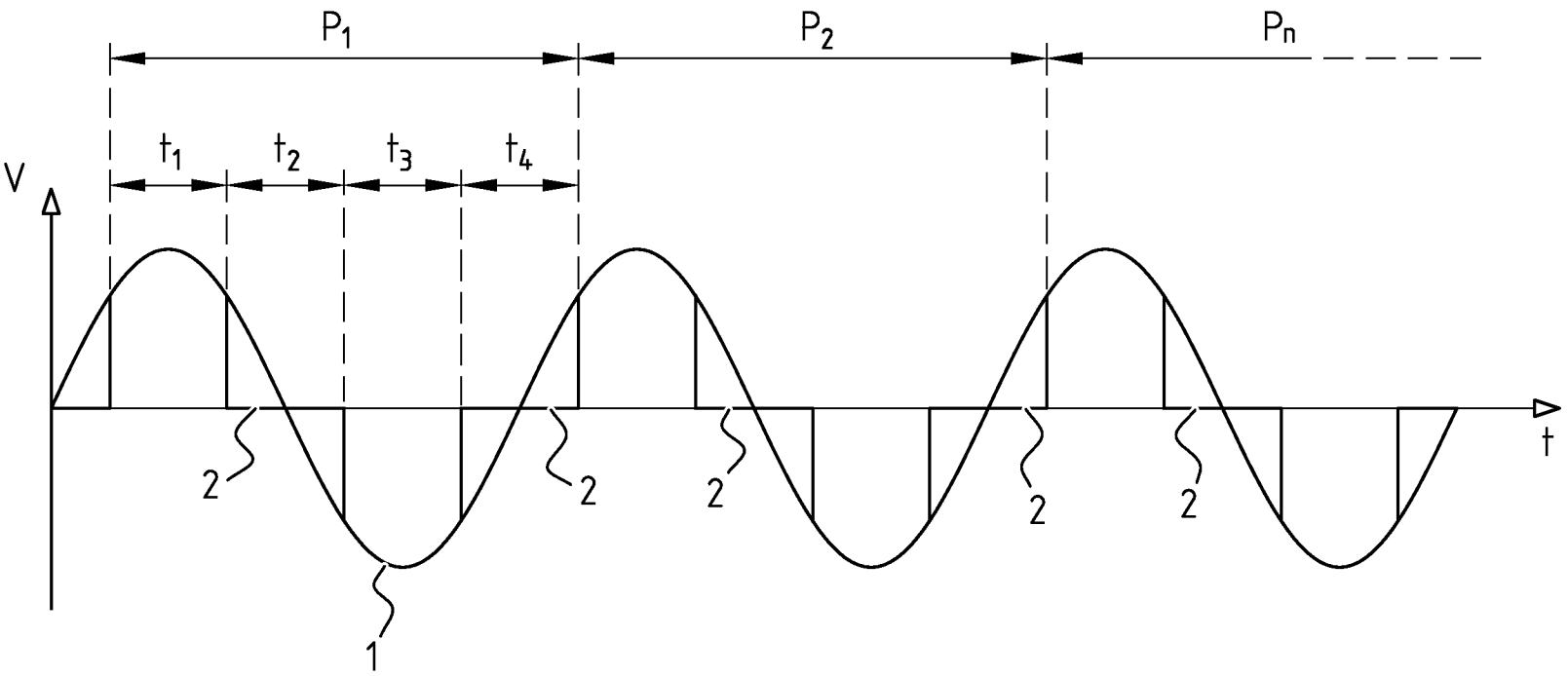
FIG. 1 shows a voltage signal and control signal optimized to control lamps in a two-wire light string.

FIG. 1 shows a signal for controlling a light string with conventional and intelligent lamps. The light string is powered by a voltage signal which is substantially the same as the mains voltage. That is, the voltage signal on the two-wire light string corresponds for at least a part of the period to the mains voltages signal. The light string can by way of example be powered by 110 VAC/60 Hz.

A communication signal is superimposed on the voltage signal. This communication signal is superimposed at a higher frequency on the voltage signal. This communication signal comprises the data which the controller sends to the lamp.

With a voltage signal the same as the US mains voltage one period lasts 60 Hz=1/60=16.67 ms. The communication signal is preferably superimposed around the zero crossings, this during a first time segment. The first time segment can for instance be equal to one quarter period.

During one period there is therefore signal superposition during twice the first time segment. When this latter is equal to a quarter period, a signal is therefore superimposed for half a period. This is 1/(2×60 Hz)=8.33 ms.

During the remaining time segments the LEDs can be provided with voltage by the voltage signal. In the example, when the first time segment equals a quarter period, this is therefore also for half the period time.

It will be apparent that it is not necessary for the first time segment to be equal to a quarter of the period, and other divisions can likewise be applied. For the sake of simplicity an example will be selected in the further description where the first time segment is equal to a quarter of the period, so that for half the time a control signal can be transmitted and for the other half of the time the LEDs can be provided with power. This example is not limitative however, and on the basis of this paragraph the skilled person will appreciate that other divisions can be selected based on the wishes of the user and the circumstances.

The LEDs are therefore off during the communication period.

LED at Maximum Intensity

When the LED is set to maximum intensity, it will then be lit for half the period time. In FIG. 1 the period P of the periodic voltage signal is divided into four segments t1, t2, t3 and t4. The control signal is transmitted during segments t2 and t4, while voltage is transmitted during segments t1 and t3. This will be apparent to the skilled person from the figure.

The voltage over the LED is realised for 50% of the time. The LED can therefore only be on for a maximum of 50% of the time. Relative to a continuous voltage signal, i.e. without the interruptions during time period t2 and t4, the maximum intensity of the LED, controlled with a signal as in FIG. 1, will be equal to about half-intensity at the same LED current. This is not wholly linear, although there will certainly be a considerable decrease in the LED intensity. It is possible to obtain the same light intensity by increasing the current. This will have to be roughly doubled, so from 20 mA to 40 mA. This is not wholly linear, and it is possible that slightly less current will also still give the same intensity.

It will depend on the LED power supply circuit whether or not this causes problems. This is because the average LED current will remain at 20 mA and can only be higher at peak. If this peak can be avoided, there is then no problem.

Several exemplary embodiments of the invention are described hereinbelow, including the theoretical calculations for the required bit rate and/or carrier wave for controlling the lamps with the communication signal.

Maximum: 200 Lamps, 24 Bit, 1.32 Mbits/sec

Assumed here is a maximum situation according to a first example, which is therefore purely theoretical! The maximum is mainly determined here in that it is not worthwhile controlling LEDs more quickly. The refresh rate would be 120 frames/second. This is already much quicker than the human eye can discern. Even faster communication can be achieved in theory however when the frequency of the carrier wave is increased still further. This example is as it were the upper limit. New data could in theory be supplied every half-period and then used to control the LEDs following communication. Half the half-period is available herefor, so a quarter:

$$1/(4\times60)=4.16666 \text{ ms.}$$

In this example 200 lamps with an exemplary resolution of 8 bits per colour could be controlled in this time, i.e. 24 bits. Suppose that they receive two extra bits for synchronization, that would then be 26 bits per lamp or 5200 bits for all lamps. Add some extra bits for preamps, error-checking, timestamp, estimated at 256 bits, so 5464 bits in total, some dead time and round off: 5500 bits.

These must therefore be transmitted in 4.16666 ms, so about 0.75 us per bit. This amounts to a bit rate of 1/0.75 μs=1.32 Mbits per second. In order to modulate this on a carrier wave this latter must at least have a frequency which is four times higher (wherein the choice is made four times to be able to create a clear 1 or 0), so 4×1320000=5280000=5.2 MHZ.

The microprocessors must also be able to process all this. In this case there is therefore a frame rate of 120 frames per second, since new data is supplied every half-period of the 60 Hz supply voltage. This is more than is necessary. This is therefore a kind of theoretical maximum.

Minimum: 170 Lamps, 18 Bits, 240 Kbit/sec

If a frame rate of 30 frames/sec is sufficient, the transfer could then take place in four time blocks. The time which is now available for sending data is 4×(¼ period)=1 period. There is therefore 1/60=16.666 ms available for one frame.

The number of bits required can also be reduced by limiting the number of lamps and the resolution. If 170 lamps are controlled with 6 bits per colour, 6×2=18 bits are thus necessary. Add another two bits for synchronization and this amounts to 20 bits per lamp. For 170 lamps this comes to a total of 170×20=3400 bits for all lamps.

Suppose that 128 bits are now necessary per block for preamps, error-checking, timestamp, this adds 512 bits, so 3912, and rounded up a total of 4000 bits. 16.666 ms are available herefor, so each bit is 4.166 μs long. This amounts to a bit rate of 1/4.166 μs=240 kbits per second. In order to modulate this on a carrier wave this latter must at least have a frequency which is four times higher, so 4×2400000=960000 Hz=0.96 MHZ.

The cable must therefore be able to transmit a signal of a minimum of 1 MHZ.

A higher available bandwidth which makes it possible to reliably transmit signals with a frequency higher than 1 MHZ can usefully be applied in the following ways:

- To increase the number of lamps, although this is not really worthwhile as DMX can only cope with 170. This is only useful in the case of control via ArtNet.
- To increase the resolution. This is more worthwhile since more intensity levels are in this way possible. This could improve dimming at low intensities. Another solution is however also possible for this purpose, see below.
- To shorten the time used to communicate. If this time becomes shorter, a LED can stay on longer and so emit more light.
- To repeat a frame in order to thus avoid errors. A frame could thus be sent not in four blocks but twice in two blocks. If a block is then not properly transmitted, the reserve block can then redress this. This does of course halve the necessary communication space.

When a higher resolution is desired, the following reasoning can be applied. The minimum as described above is used as basis, so 30 frames per second, wherein four blocks are transmitted for a total of 170 lamps. The resolution is however increased to 8 bits per colour, so 24 bits per lamp. 2 extra bits, so-called start/stop bits, are added per 8 bits. A UART can in this way receive the data and it is certain that there is a high to low transition every 10 bits. The total number of bits for the colour information hereby comes to 170×3×10=5100.

Suppose that 160 bits are now necessary per block for preamps, error-checking, timestamp, this adds 4×160=640 bits, so 5740, and rounded up 5800 bits. 16.666 ms are available herefor, so each bit is 2.87 μs long. This amounts to a bit rate of 1/2.87 μs=348 kbits per second. In order to modulate this on a carrier wave this latter must at least have a frequency which is four times higher, so 4×348000=1392000 Hz=1.392 MHZ. The cable must therefore be able to transfer a signal of a minimum of 1.4 MHZ.

Preferred Embodiment

Suppose that the choice is made to halve the communication time so that the LED can be on for longer. That is, t2 and t4 become shorter than t1 and t3 so that the voltage signal transmitted during t1 and t3 lasts longer than half the period. The result hereof is that less time is available for transmitting the communication signal sent during time blocks t2 and t4.

In the preferred exemplary embodiment each block may last a maximum of 1/(8×60)=2.0833 ms, rounded off 2 ms. There is therefore 4×2 ms=8 ms available for one frame. 5800 bits still have to be sent, so each bit is 8 ms/5800=1.38 μs long. This corresponds to a bit rate of 725000 bits per second=725 kbits/sec. In order to modulate this on a carrier wave this latter must at least have a frequency which is four times higher, so 4×725000=2900000 Hz=2.9 MHZ.

The cable must therefore be able to transmit a signal of a minimum of 3 MHZ.

In a preferred embodiment an intelligent lamp is provided with a microprocessor adapted for power line communication (PLC). The PLC microprocessor is provided for the purpose of processing the communication signal. For 725 kbit/sec 1.38 us is available for each bit. If the processor operates at 24 MHZ, this then amounts to 33.12 clock cycles. If the processor can execute one instruction per clock cycle, this then amounts to 33 instructions. This is a relatively small number.

If use can be made of a hardware circuit which can receive and stock the bits in a buffer, the processor will then be able to process the signal much more easily. This would for instance be possible with a UART which can receive 8 or 9 bits per step. Extra start and stop bits, for which allowance is already made, are then provided for this purpose. The advantage is that there is a synchronization every 10 bits, as well as at least one high to low transition. In the case of bit errors it may well be that incorrect data are received, so a CRC is necessary to detect this. The processor therefore has in this case 10 bits the time to execute code, so 331 clock cycles. A great deal can be done here.

Alternatively, an SPI can be provided which can also read 8 bits. This is often more difficult to synchronize in practice and requires additional external hardware. A further alternative is to read at a higher bit rate, a type of capturing, and to calculate the effective bits from this data. This then again requires processing time.

Tests have indicated that stepless fading of a LED at a frame rate of 30 frames/sec is not feasible, particularly at the low intensities. It will be apparent in this respect that stepless fading is defined as fading wherein an average person can discern a stepwise increase or decrease in intensity with the naked eye. It is noted here that the frequency of effective transmission of light by the LED is not 30 times per second but 120 times per second. This is because there are four cycles in which the LED is provided with voltage.

The LED is therefore preferably provided with control electronics in order to always transpose from the one intensity to the other in four cycles by means of an internal fading. There is then a good chance of the dimming progressing very much better, particularly at low intensities.

The change in intensity can more preferably be spread over eight cycles by recalculating the intensity every fourth fading (so every frame) from the current to the desired value.

The fading need not have a linear progression and is also possible along a determined curve so that at low intensities the steps are also smaller. This in combination with a >=10 bits PWM will give attractive light changes. This is advantageous as it determines the light quality to great extent.

FIG. 1 shows a graph wherein the horizontal axis is a time axis and the vertical axis shows a voltage. The graph hereby shows a voltage signal which can be generated by the controller, which voltage can be applied to the second wires of the two-wire light string. It will be apparent to the skilled person here that a voltage is always measurable between two wires, wherein one wire can be a neutral wire and the other wire can comprise the absolute voltage so that the voltage is measurable between the two wires. The wires can alternatively be floating, wherein the absolute voltage of each wire is irrelevant per se and wherein the difference between the absolute voltage of the one wire and the absolute voltage of the other wire is the desired voltage illustrated in FIG. 1.

The voltage signal of FIG. 1 is preferably periodic. That is, the voltage has the same progression in successive time periods. These time periods are designated in FIG. 1 as time period $P_1$, $P_2$, $P_n$.

The voltage signal is generally sine-shaped and preferably substantially the same as the mains voltage in frequency and amplitude. The voltage signal is preferably provided here with the control signal at the zero crossing. The control signal is superimposed on the voltage signal. The voltage signal continues during the time segments t2 and t4 while the control signal is added by the controller. The superimposing of a high-frequency control signal on a low-frequency voltage signal is generally known and therefore not further discussed in detail. During time segments t1 and t3, in which no control signal is transmitted, the LEDs are provided with power. The LEDs will switch on and off during these time periods, for instance via a PWM, in order to take up the desired power from the voltage signal. It will be apparent here that the intensity of the LED is influenced by the ratio of on/off time during the PWM operation. This is known to the skilled person and therefore not discussed in detail.

In an alternative embodiment the voltage signal is cut off during time segments t2 and t4 by a leading edge phase control or trailing edge phase control, for instance by means of a chopper, so as to have no voltage to speak of, also referred to as voltage 0, during a segment of the voltage signal. This is preferably done twice per period because there are two zero crossings per period in an alternating voltage signal. Each period P of voltage signal 1 is hereby divided into four parts t1, t2, t3 and t4. During time segments t1 and t3 the voltage signal is not cut off and power can be supplied. During time segments t2 and t4 the signal is cut off, designated in FIG. 1 with reference numeral 2, and as described above a control signal with a high frequency and with an amplitude which is negligible relative to the amplitude of voltage signal 1 is transmitted by the controller. This embodiment is also deemed as superimposition of a control signal on a voltage signal, even though technically the two signals are generated successively of each other and not overlapping.

In a further alternative embodiment (not shown) the voltage signal is a direct-current voltage, DC voltage. A period can be freely determined here and each period can be divided into an even number of segments, for instance into two segments, in order to obtain the same effect as described above.

Applying such a signal as shown in FIG. 1 to a two-wire light string has the result that conventional lamps will be lit as a result of the voltage signal 1, while intelligent lamps as described above are on the one hand provided with voltage by the voltage signal and are on the other simultaneously controllable by the control signals transmitted during time segments t2 and t4. A two-wire light string can thus be provided with a random combination of conventional lamps and intelligent lamps.

Figure 2:
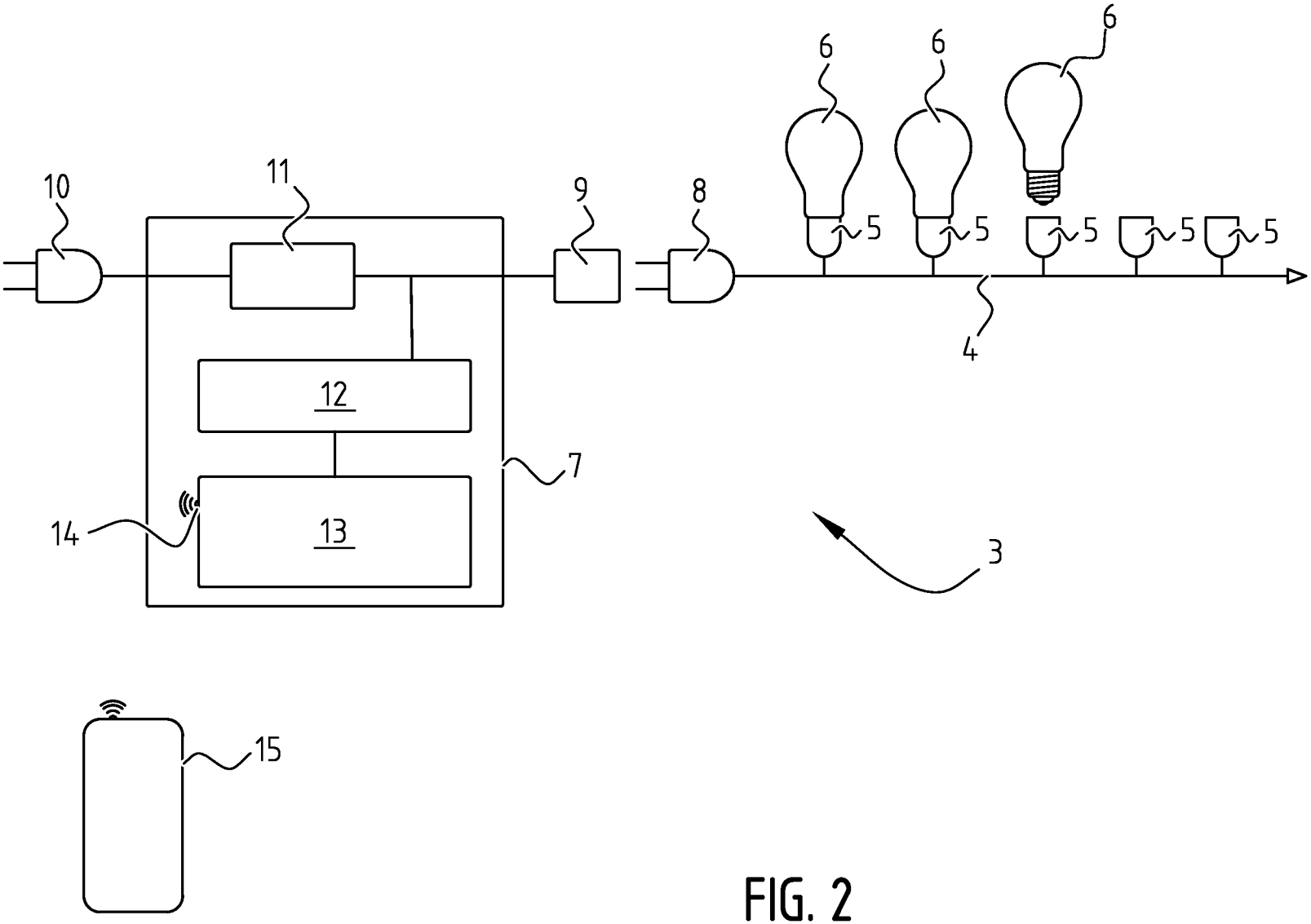
FIG. 2 shows an assembly of a controller and a two-wire light string.

FIG. 2 shows the physical components of lighting assembly 3 according to an embodiment of the invention. Lighting assembly 3 comprises a two-wire light string 4 with a plurality of sockets 5. Sockets 5 are placed in parallel relative to each other on two-wire light string 4. Each socket 5 is provided so as to connect a lamp 6 to the wires of two-wire light string 4. Known, typical sockets, such as E14, E27, GU10 and others, can be provided for this purpose.

A controller 7 is further provided for placing between the mains and two-wire light string 4. Controller 7 has for this purpose a mains connection 10. The two-wire light string can be either connected directly to controller 7 or connected indirectly as shown in FIG. 2 by means of complementary connecting elements 8 and 9. Connecting element 8 of two-wire light string 4 can be formed here as a mains connection element, so that two-wire light string 4 can also be connected directly, i.e. without controller 7, to the mains. When mains connection 8 is connected to connector 9, light string 4 can be connected via controller 7 to the mains.

Controller 7 comprises a filter 11 for blocking the control signals. Filter 11 hereby filters the control signals out of the two-wire light string such that these signals cannot enter the mains supply. Controller 7 further comprises a module 12 for forming the voltage signal and control signal as shown in FIG. 1. Controller 7 preferably further comprises a pattern generator 13 for generating lighting patterns. Pattern generator 13 allows control of the lamps in two-wire light string 4, in particular the intelligent lamps, for the purpose of changing their intensity and/or colour in dynamic manner over time. Different festive moods can hereby be created. Filter 11 is preferably also provided for the purpose of filtering high-frequency interference resulting from the PWM of the LEDs.

Pattern generator 13 can be provided with a communication module 14 for communicating with an electronic end-user device 15. An example hereof is a smart phone, which can then be used to program or select the pattern from a prearranged series of patterns.

Figure 3:
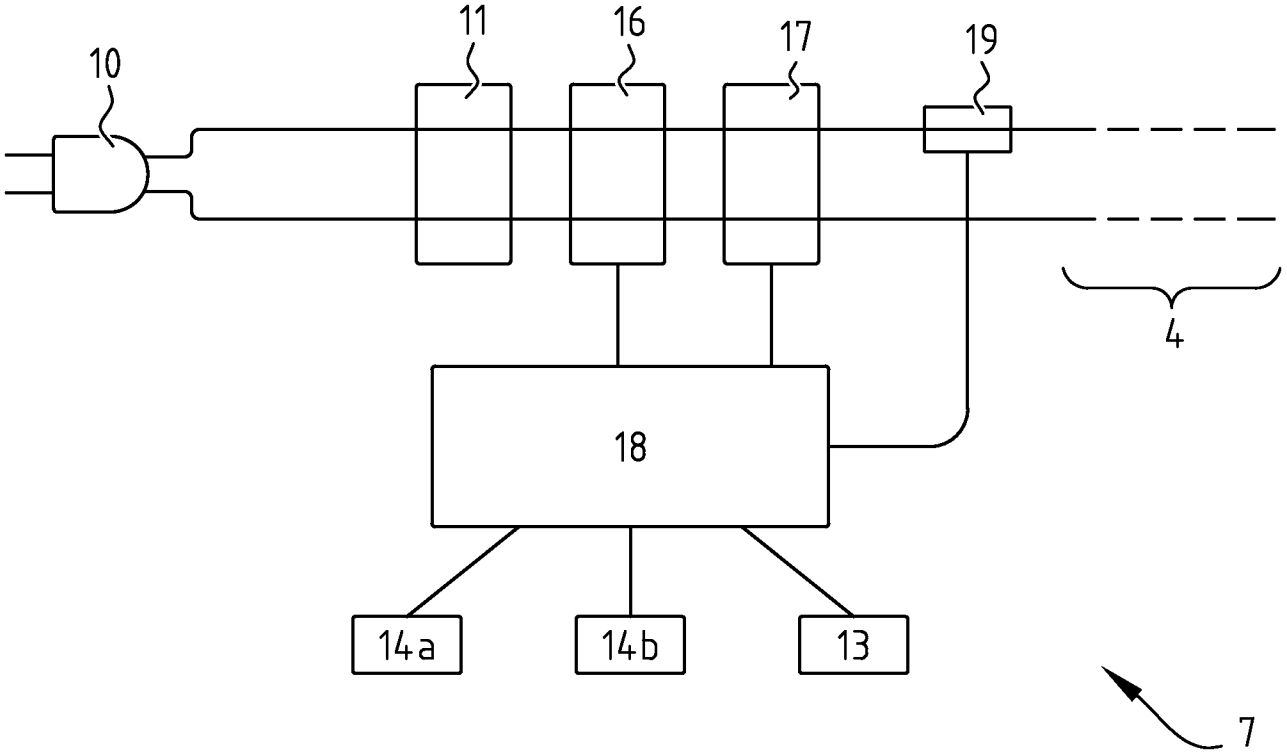
FIG. 3 shows a preferred embodiment of controller 7.

FIG. 3 shows a preferred embodiment of a controller 7. Controller 7 has a mains connection 10 which is provided so as to receive a mains voltage signal. This mains voltage signal preferably forms, through a direct connection between mains connection 10 and light string 4, the voltage signal on light string 4. It will be apparent here that the 'direct' connection does not preclude elements such as a filter and/or modem being added between mains connection 10 and light string 4, which elements can have a minimal influence on the voltage signal. The skilled person will however appreciate that the mains voltage signal is transmitted for the greater part directly from mains connection 10 to light string 4. Controller 7 incorporates a plurality of elements, designated with reference numerals 11, 16, 17, 19, which will be discussed in further detail below.

The element designated with reference numeral 11 is the filter for blocking the control signals. Filter 11 is positioned in controller 7 closest to mains connection 10. Filter 11 can thus block the control signals generated on the other side of controller 7, in FIG. 3 the right-hand side of controller 7. It will be apparent here that blocking of the control signals by filter 11 will not in practice block 100% of the control signal. Filter 11 is preferably a low-pass filter, wherein several frequencies below a predetermined frequency are allowed to pass through. High-frequency signals can be blocked by a low-pass filter.

The element designated with reference numeral 16 is a zero crossing detector. On the basis of a detection of the zero crossing of the voltage signal received via mains connection 10 a plurality of devices connected to the power wires can be synchronized. Clocks for generating control signals, already discussed above and also further elucidated below, can be controlled and preferably synchronized on the basis of detection of the zero crossing.

The element designated with reference numeral 17 is a modem. Modems are known and are provided for the purpose of applying a signal to a set of wires. Modem 17 of controller 7 is provided for the purpose of superimposing on the voltage signal the control signal supplied by the controller electronics 18. In the configuration of FIG. 3 the controller electronics 18 comprise the internal clock which is kept synchronized by zero crossing detector 16, and wherein controller electronics 18 send the signals for superimposing on the voltage signal to modem 17.

Controller 7 further comprises a current meter 19. Current meter must in the first instance be broadly interpreted in the sense that current meter 19 can directly and/or indirectly determine a change in current through light string 4. In accordance with the broad interpretation a voltage measurement can also be deemed as current measurement, since a change in current can be determined via the voltage measurement. This is because light string 4 has a resistance which is typically substantially constant, so that voltage and current are related. The current is preferably measured directly by a current meter.

Controller 7 further comprises communication modules 14, in the embodiment of FIG. 3 two communication modules 14*a* and 14*b*. 14*a* can thus be an ethernet communication module, while 14b is a WiFi communication module. It will be apparent to the skilled person that other communication modules, such as a 4G or predecessor or successor thereof, can also be integrated as communication module 14. Controller 7 further comprises a pattern generator 13 as already described above.

Obtained with the structure of FIG. 3 is a controller 7 which can superimpose a control signal on a voltage signal from the mains connected by mains connection 10, wherein controller 7 can further be kept synchronized with other devices, lamps, which are discussed below with reference to FIG. 4, on the basis of the zero crossing of the voltage signal determined by the zero crossing detector 16.

Figure 4:
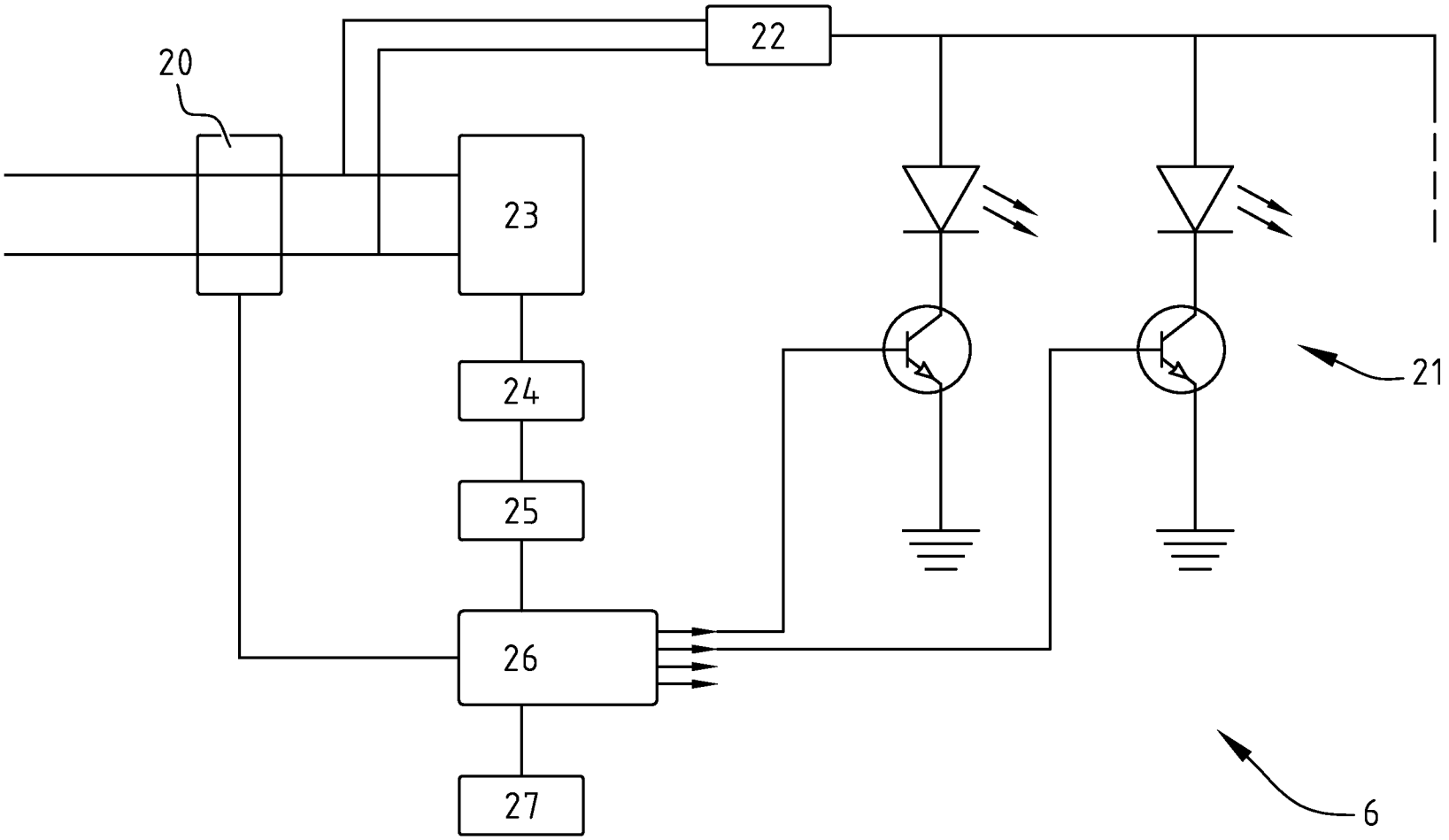
FIG. 4 shows a preferred embodiment of a lamp.

FIG. 4 shows a preferred embodiment of a lamp 6 according to the invention, wherein the different elements responsible for functioning of lamp 6 are elucidated in detail. Lamp 6 has a zero crossing detector 20. This zero crossing detector 20 has the same function as zero crossing detector 16 of controller 7. Via zero crossing detector 20 the internal clock of lamp 6 for reading the control signal can be synchronized with the internal clock of controller 7.

The voltage is further carried via a rectifier 22 to LEDs 21 so that the LEDs are provided with a predetermined current. LEDs 21 have an individual control, shown in FIG. 4 as a transistor, which is controlled by a control module 26. The skilled person will appreciate how the transistor can determine how the current through LEDs 21 can be switched on and off by PWM so as to be thus limited. A LED 21 can hereby be dimmed.

Lamp 6 further comprises a high-pass filter 23 for filtering high-frequency signals out of the power wires. It will be apparent here that the voltage signal is typically low-frequency, for instance 50 Hz or 60 Hz, while the control signal superimposed onto the voltage signal by modem 17 is high-frequency. This high-frequency signal 23 is controlled via an on/off keying 24 module in order to filter the signal. A further filter 25 is optionally added in order to get the control signal in clearly readable form to control module 26. On/off keying 24 module and/or filter 25 can alternatively be replaced by equivalent or similar modules, for instance by a demodulator module which decodes the signal data. Control module 26 is further connected to a memory 27 in which the lamp can store an address.

The lamp has two working modes, being an operating mode and an initializing mode. The initializing mode is active for a predetermined time after the voltage signal is connected to lamp 6. The lamp operates for instance in the initializing mode for one second after the voltage signal is connected to lamp 6. After this predetermined time, for instance after this one second has passed, the lamp will operate in its operating mode.

In the initializing mode lamp 6 is available for receiving an address. In the initializing mode controller 7 will typically transmit an address repeatedly. The lamp which is in the initializing mode will receive and store this address in memory 27.

In the operating mode lamp 6 scans the control signal to find an address which is the same as the address stored in memory 27. The instructions in the control signal related to this address are executed by control module 26.

During installation of a lighting assembly according to the invention the light string will be substantially empty and provided with voltage by the controller. That is, the voltage is applied to the wires of the light string. The controller is in an initializing mode, whereby the controller repeatedly transmits an address. When a lamp is placed in the light string, this lamp automatically enters the initializing mode through the connection of lamp 6 to socket 5 because the lamp only receives voltage once it is fitted in socket 5. This lamp receives the address transmitted by the controller and stores it in memory 27.

As a result of the storing in memory 27 the control module 26 is configured to make LED 21 produce an intensity peak, for instance a (light) flash. This flash or intensity peak produces a current peak through light string 4 which is detectable by current meter 19 of controller 7. Controller 7 in this way knows that the transmitted address has arrived at the lamp. It is noted in this respect that controller 7 receives confirmation of receipt without the lamp sending back a high-frequency data communication signal via the wires of light string 4. It is further noted in this respect that the intensity peak is also a confirmation to the installer that the address has arrived correctly at the lamp and has been stored in memory 27 thereof. The operator knows at the moment that he/she sees the lamp flashing that controller 7 has also received this confirmation, and transmits a subsequent address. This allows the operator to fit a following lamp in a socket 5.

When fitted into the socket this following lamp enters the initializing mode. The previous lamp (which has received and stored the previous address) has already been provided with voltage for a longer period because it was fitted earlier into socket 5 and is operating in the operating mode and will therefore not respond to the repeated transmission of the new address. The newly fitted lamp will be in the initializing mode for a first predetermined time period, and will thus receive the address.

With the above described technical choices a simple system is obtained for dynamic configuration and installation of a light string with a plurality of lamps, wherein a unique address can be given to each lamp without complex two-way communication having to be implemented. It is also easy for an operator or installer to detect when a lamp has been correctly installed. The operator or installer does not require any programming knowledge to install the light string correctly and to be able to correctly address the lamps. This is a considerable advantage relative to known systems.

In order to make the system more intelligent the lamps can be provided so as to generate a flash pattern when an address is received. Depending on the pattern generated by the lamp, the controller will be able to measure a corresponding current variation pattern via current meter 19, whereby a feedback can be implemented with greater certainty.

Controller 7 can be provided so as to be connected to a user interface in which a counter is provided. The counter is related to the addresses of the light string so that, by changing the counter, an operator can designate lamps with different addresses. When a random lamp in the light string fails, the operator can go to the address of this lamp with the counter, after which the operator can remove this lamp. The controller is preferably controlled here, when the counter is active, to switch on only the lamp with the address related to the position of the counter. This allows a user to check the address of each lamp in simple manner.

The controller can be set in the initializing mode with the counter in a position related to the failed lamp. The operator can then insert a new lamp. A lamp can in this way be replaced and correctly addressed in extremely simple manner. It is again noted here that the operator or installer does not need any appreciable programming knowledge and that the operator or programmer receives in extremely simple manner confirmation that the address has arrived properly at the lamp.

The skilled person will appreciate on the basis of the above description that the invention can be embodied in different ways and on the basis of different principles. The invention is not limited here to the above described embodiments The above described embodiments and the figures are purely illustrative and serve only to increase understanding of the invention. The invention will not therefore be limited to the embodiments described herein, but is defined in the claims.

The invention claimed is:

1. A lamp for use in a lighting assembly comprising a two-wire light string, wherein the lamp is adapted for fitting in a socket of the two-wire light string and receiving a voltage signal and a superimposed control signal via the two-wire light string and the socket, and wherein the lamp comprises:

control electronics provided for the purpose, when the lamp has been fitted in a socket, of receiving voltage via the voltage signal and receiving instructions via the control signal superimposed on the voltage signal, at least one LED source, of which at least one of an intensity and a colour is adjustable on the basis of the instructions via the control electronics;

wherein the control electronics are further provided for receiving an address for the lamp via the control signal superimposed on the voltage signal and for subsequently confirming receipt of the address.

2. The lamp of claim 1, wherein the control electronics are provided for confirming receipt of the address by controlling a current supplied to the at least one LED source.

3. The lamp of claim 1, wherein the control electronics are provided for generating an intensity peak of the at least one LED source as confirmation of receipt of the address.

4. The lamp of claim 1, wherein the control electronics are provided, by controlling the current supplied to the at least one LED source, to visually confirm receipt of the address to a user.

5. The lamp of claim 1, wherein the lamp has a memory for storing the address.

6. The lamp of claim 1, wherein the lamp is configured to be available to receive the address for a first predetermined period after receiving the voltage signal.

7. The lamp of claim 6, wherein the lamp is configured for after the first predetermined period entering an operating mode in which the control electronics are provided so as to read the control signal in order to receive instructions related to the address stored in the memory.

8. A lighting assembly comprising:

a two-wire light string, wherein sockets are placed in parallel at different positions of the two-wire light string, wherein each of the sockets is provided so as to connect a lamp to the two wires;

a controller at one end of the two-wire light string, the controller is configured so as to provide a voltage signal over the two wires, and the controller is configured so as to superimpose a control signal on the voltage signal, wherein the controller further comprises a mains connection and a filter between the two-wire light string and the mains connection, the filter is configured for the purpose of blocking propagation of the control signal from the two-wire light string to the mains connection; and at least one lamp according to claim 1 fitted in the sockets of the two-wire light string;

wherein the controller is configured to repeatedly transmit an address for the lamp as control signal during an initializing cycle prior to a working cycle, wherein the controller is further configured to generate instructions for each initialized lamp as control signal in a working cycle.

9. The lighting assembly of claim 8, wherein the controller comprises a current meter.

10. The lighting assembly of claim 8, wherein the voltage signal has a periodic progression, and wherein the control signal is transmitted during at least one time segment within the periodic progression.

11. The lighting assembly of claim 8, wherein the controller further comprises a communication module for communication with an end-user device for configuring the controller.

12. The lighting assembly of claim 8, wherein the controller is provided for being connected to a user interface in which a counter is provided, wherein the counter is related to the addresses of the light string so that, by changing the counter, an operator can designate lamps with different addresses.

13. A method for controlling a lighting assembly comprising a two-wire light string, wherein sockets are placed in parallel at different positions of the two-wire light string, wherein each of the sockets is provided so as to connect a lamp to the two wires and wherein a controller is provided at one end of the two-wire light string, wherein the method comprises of:

providing a voltage signal over the two wires with the controller;

superimposing a control signal on the voltage signal of the lighting assembly;

blocking propagation of the control signal from the two-wire light string to a mains connection of the controller with a filter in the controller;

starting an initializing cycle in which the following sequence of steps is repeated of:

repeatedly transmitting an address for a lamp as control signal with the controller;

fitting the lamp in one of the sockets, the lamp comprises at least one LED source, of which at least one of an intensity and a colour is adjustable on the basis of instructions via control electronics in the lamp, and wherein the control electronics are provided for the purpose, when the lamp has been fitted in a socket, of receiving voltage via the voltage signal and receiving the instructions via the control signal;

the lamp receiving the address;

following receipt of the address, the control electronics of the lamp confirming receipt of the address;

stopping the initializing cycle;

starting a working cycle wherein the control signal comprises instructions for each initialized lamp.

14. The method of claim 13, wherein the confirming receipt of the address comprises controlling current supplied to the at least one LED source.

15. The method of claim 14, wherein the current is controlled to generate an intensity peak of the at least one LED source.

16. The method of claim 14, wherein the current is controlled to visually confirm receipt of the address to a user.

17. The method of claim 13, wherein the confirming receipt of the address comprises generating an intensity peak of the at least one LED source and wherein the initializing cycle further comprises detecting with the controller a current peak resulting from the generated intensity peak for the purpose of confirming receipt of the address by the lamp.

18. The method of claim 13, wherein in the working cycle the controller transmits successive instructions as control signal for the address, and wherein each lamp is provided so as to filter the instructions related to its received address out of the control signal.

19. The method of claim 13, wherein the method further comprises connecting the controller to a user interface in which a counter is provided, wherein the counter is related to the addresses of the light string so that, by changing the counter, an operator can designate lamps with different addresses.

* * * * *